United States Patent [19]

Coop, Sr. et al.

[11] 4,380,920

[45] Apr. 26, 1983

[54] ADJUSTABLE WIPER DIE FOR BENDING TUBULAR MEMBERS

[76] Inventors: Jeffrey W. Coop, Sr.; Jeffrey W. Coop, Jr., both of 12924-30 Lakeland Rd., Santa Fe Springs, Calif. 90670

[21] Appl. No.: 196,361

[22] Filed: Oct. 14, 1980

[51] Int. Cl.[3] ..... B21D 7/04

[52] U.S. Cl. ..... 72/158

[58] Field of Search ..... 72/149, 150, 154, 155, 72/157, 158, 159, 369, 370, 473, 478, 481, 482

[56] References Cited

U.S. PATENT DOCUMENTS

| | | | |
|---|---|---|---|
| 878,604 | 2/1908 | Brinkman | 72/159 X |
| 1,135,875 | 4/1915 | Brinkman | 72/159 X |
| 1,261,191 | 4/1918 | Vallone | 72/159 X |
| 2,721,651 | 10/1955 | Roth | 72/478 |
| 2,777,500 | 1/1957 | Ekholm et al. | 72/150 X |
| 3,410,125 | 11/1968 | Schmidt | 72/156 |
| 3,456,482 | 7/1969 | Maier et al. | 72/159 X |
| 3,457,753 | 7/1969 | Maier et al. | 72/159 X |
| 3,898,835 | 8/1975 | Winter et al. | 72/481 X |
| 4,009,601 | 3/1977 | Shimizu | 72/150 X |
| 4,325,244 | 4/1982 | Stowe et al. | 72/158 |

FOREIGN PATENT DOCUMENTS

| | | | |
|---|---|---|---|
| 2303619 | 10/1976 | France | 72/149 |

*Primary Examiner*—Ervin M. Combs

*Attorney, Agent, or Firm*—Francis X. LoJacono

[57] ABSTRACT

A wiper die which is arranged to be adjustable as wear takes place during the bending of tubular members. The adjustable wiper die comprises a fixed carriage which is secured in a contiguous relationship with respect to the bending die, and includes an adjustable wiper blade that is mounted to the carriage for slidable adjustment by means of a positioning gauge supported within the carriage block, the positioning gauge being arranged with a movable pawl member for engagement with one of the selective notches formed in the wiper blade, whereby the projecting lip of the wiper blade can be readily located in a continuous working position with the bending die.

8 Claims, 6 Drawing Figures

ADJUSTABLE WIPER DIE FOR BENDING TUBULAR MEMBERS

BACKGROUND OF THE INVENTION

1. Field of the Invention

This invention relates generally to a bending tool for tubular pipes and like members, and more particularly to the wiper die member of the bending tool.

2. Description of the Prior Art

It is well known in the art that various problems and difficulties are being encountered in providing a suitable means for aiding in bending tubular members, without causing bending defects in the tubular structure. That is, a very common problem in the art of bending tubular members is the creating of wrinkles in the surface of the tubular structure along the smaller inner radius of the bend, or the area just following the bend portion thereof.

In order to prevent such wrinkes from forming during the bending process, a tool member known as a wiper die is positioned adjacent the rotatable bending form at the entrance side of the die tool. This prevents wrinkles from forming, as long as the formed projecting lip of the wiper die remains in its required position relative to the channeled rotatable bending form.

However, due to the continuous use thereof, there is caused a very-high wear factor at the thinly formed lip member of the wiper die. Thus, at the present time, the wiper die is made from a solid block member at great expense; and it must be removed when worn, and the lip portion reformed. It has become very time-consuming and costly because of the necessity for constant downtime, as well as the requirement for many replacement wipers.

Accordingly, there is a need for a wiper tool that can be adjusted to perform as required, without the necessity for removing the wiper die to do so. Such a tool is herein disclosed that substantially overcomes the above problems.

SUMMARY AND OBJECTS OF THE INVENTION

The present invention has for an important object to provide a wiper die for bending tubular members which includes an adjustable and replaceable wiper blade to eliminate the necessity for constantly replacing the entire wiper-die member each time it is worn to a point where it does not prevent wrinkling of the tubular structure as it is bent into shape.

It is another object of the invention to provide a wiper-die tool that comprises a fixed wiper block having a wiper blade mounted thereto and adapted to be adjustable with respect to the bending-form member, as the wiper blade wears, thus establishing a means for preventing wrinkles from forming in the tubular structure during bending.

Still another object of the invention is to provide a wiper die having an adjustable wiper blade that is arranged and designed to be self-sharpening during the bending operation, whereby the projecting wiper lip is simultaneously worn on both sides.

A further object of the invention is to provide a wiper-die tool wherein the main body member is affixed in its proper relationship with the bending-form member, and allows for the simple replacement of a worn wiper blade, rather than a single wiper-die tool; and wherein the wiper body is further provided with an adjustable mechanism that engages the wiper blade for longitudinal positioning thereof as it wears.

A still further object of the invention is to provide a wiper die that will reduce the cost of providing a complete set of new tools, or the necessity of having several complete sets of tools available due to wear problems, as is now the case.

Still another object of the present invention is to provide a wiper-die tool of this character that is easy to service and maintain, and has relatively few operating parts.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
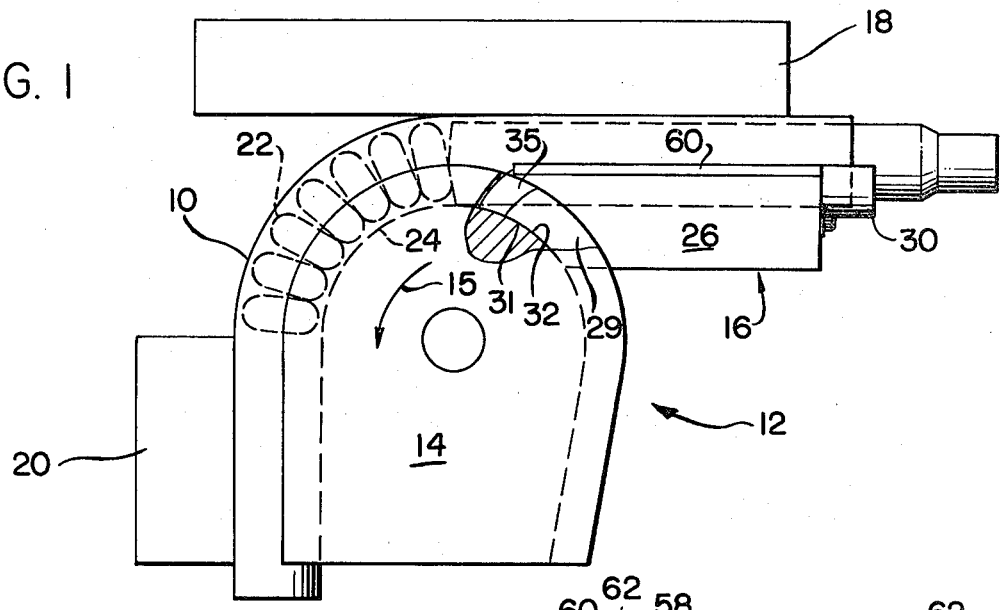
FIG. 1 is a plan view in diagrammatic form illustrating a tubular member being bent to be formed in a typical bending operation, including the present invention.

Referring more particularly to FIG. 1, there is shown a tubular structure 10 being bent by a bending machine, generally indicated at 12. The bending machine 12 includes a bending form, or die tool, 14 that is arranged to rotate in a counter-clockwise direction, as indicated by arrow 15. Positioned adjacent the bending die is the present invention, known as a wiper die, designated at 16, which is generally secured in a fixed position relative to the bending die 14. Thus, a tubular member 10 is positioned between the wiper die and a follower-type pressure die member 18. A clamp-die member 20 clamps the leading portion of the tubular member 10 against the bending die 14, so as to move therewith and cause the tube 10 to bend, as shown in FIG. 1. Prior to bending tubular member 10, a flexible ball mandrel 22 is generally inserted therein to provide and establish a uniformly smooth bend.

Accordingly, in order to prevent wrinkling from occurring along the smaller radius 24 of the tubular structure 10, wiper die 16 must at all times be in close contact with the channel portion of the bending die 14. Hence, wear will occur at the contact points between the wiper die 16 and the bending die 14, and between the tubular member 10 and the contacting surface of the wiper die 16.

In order to compensate for the continuous wear of the leading edge of wiper die 16, the wiper die comprises a carriage member 26 (which is affixed so as not to move during the bending operation) and an adjustable wiper blade 30. Carriage member 26 is defined by a main body formed from any suitable metal; however, a lightweight aluminum structure is preferable. The carriage or body 26 is formed having a semi-circular cradle defined by a longitudinal channel 27 which terminates at the front contacting end 28. The front contacting end is provided with a jaw-like member 29, the jaw member being shaped having a compound curved surface 31 which is formed to match and be received in the compound curved surface of the annular channel disposed in the bending die 14, as seen in FIG. 1.

The adjustable wiper-blade insert 30 comprises a semi-circular channel member of predetermined length corresponding to the matching semi-circular channel 27 of carriage 26, the wiper blade 30 being formed from a suitable material (preferably brass metal). The leading end of wiper blade 30 is formed with a protruding lip 35 having a compound curved surface, similar to curved surface 31 of jaw member 29. Thus, a sharply defined edge 36 is created, whereby the wear on both sides of lip 35 will constantly provide a well-defined edge. Accordingly, wiper blade 30 need only be adjusted in a forward manner, so as to remain in the required contacting position with bending die 14. The adjusting of wiper blade 30 is accomplished by an adjustable gauge means, generally indicated at 38, comprising a threaded screw pin 40 which is positioned in the carriage block. That is, carriage block 26 is provided with a longitudinal recess 42 adapted to receive screw pin 40 so as to be rotated therein by pin head 44, which may be defined by an Allen-head type recess. Screw pin 40 is held in rotational arrangement by a keeper member 45 which is secured to block 26, and clamps about the neck member 46 of pin 40.

Figure 5:
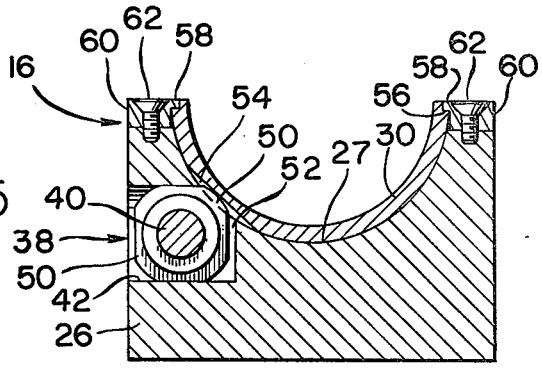
FIG. 5 is a cross-sectional view of the wiper die taken substantially along line 5—5 of FIG. 2.
Figure 2:
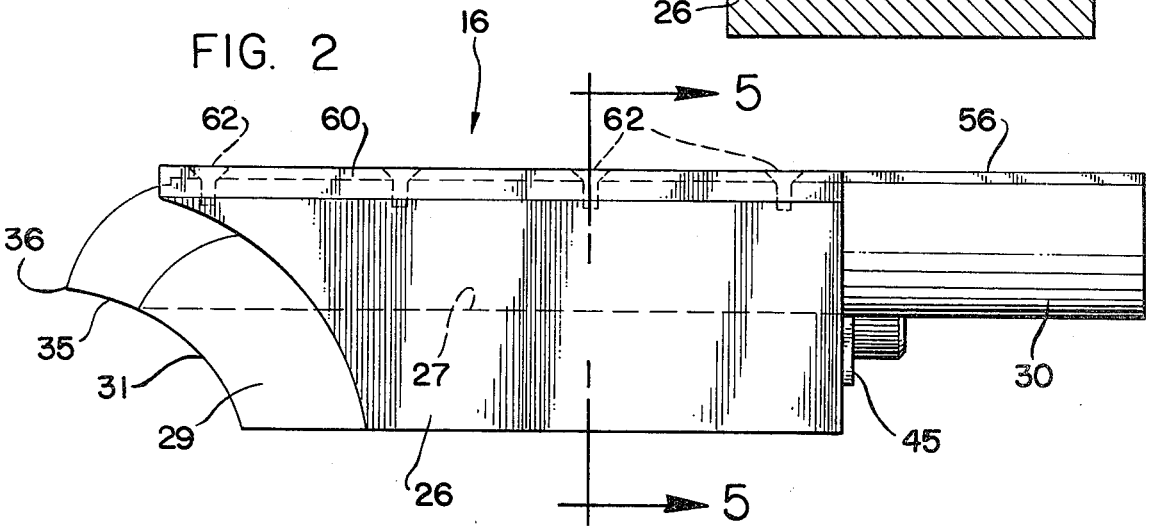
FIG. 2 is an enlarged side-elevational view of the wiper-die tool.
Figure 3:
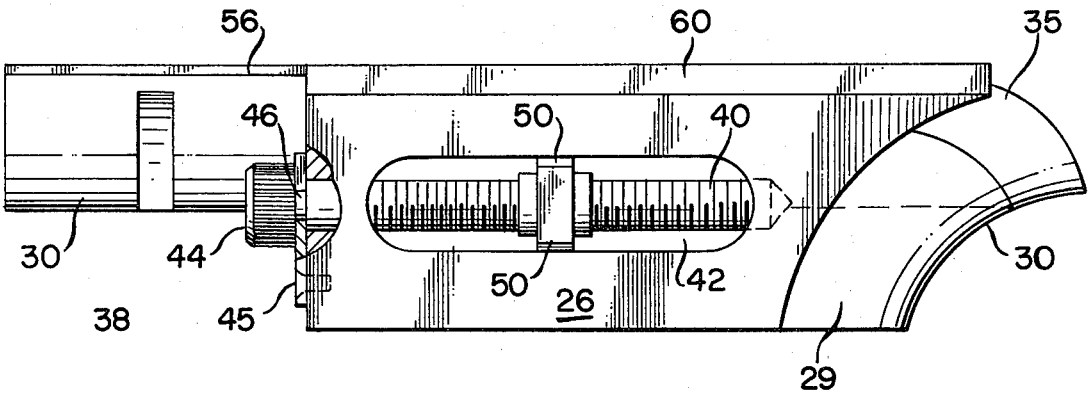
FIG. 3 is a side-elevational view of the opposite side thereof, showing the means employed to longitudinally adjust the wiper blade.
Figure 4:
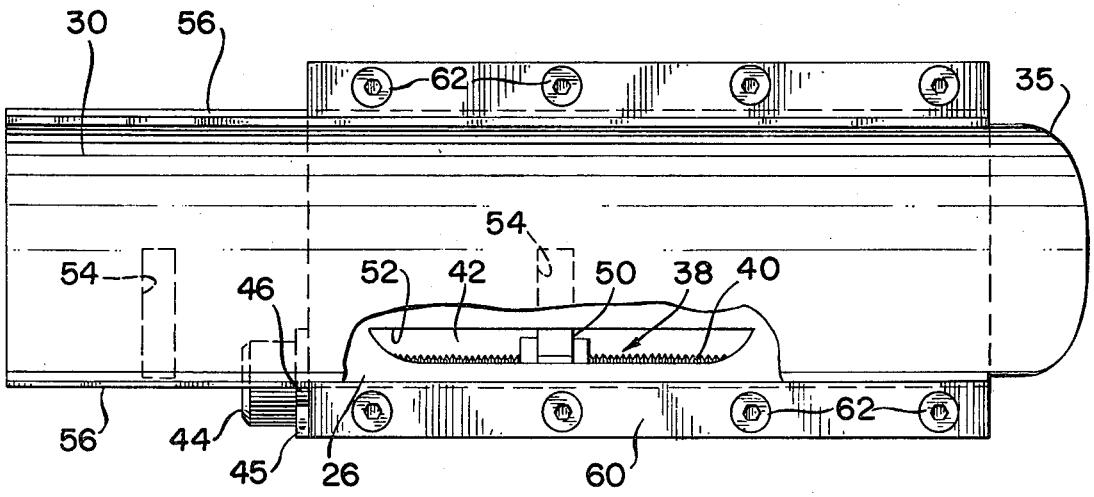
FIG. 4 is a top-plan view thereof, with a portion of the wiper blade broken away to show the position of the adjustable pawl member which engages one of the notches formed in the wiper blade.
Figure 6:
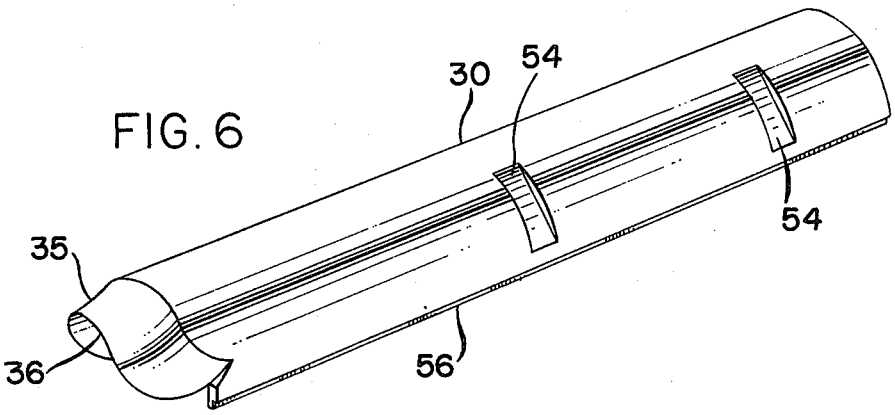
FIG. 6 is a perspective view of the underside of the wiper-blade member.

Threadably supported on screw pin 40 is a pawl 50 having a generally rectangular configuration to match recess 42, whereby pawl 50 can be moved longitudinally back and forth within recess 42. At least one of the corner edges 50, as seen in FIG. 5, is positioned to project outwardly from slot 52, so as to engage one of the transverse notches 54 formed on the under curved surface of blade 30.

Wiper blade 30 further includes longitudinal grooves 56 oppositely disposed along the full length of the edges thereof and adapted to receive the projecting flange 58 of clamping rails 60. Each rail 60 is secured to block 26 by a plurality of screws 62, thereby securing wiper blade 30 into an operating position on block 26. Accordingly, as the leading edge 36 wears, the clamping rails are loosened—allowing the wiper blade 30 to be adjusted by the movement of pawl 50. After adjustment of the wiper-blade member, rails 60 are again secured tightly to block 26—thus clamping wiper blade 30 in a locked position.

Thus, it should be understood that, when wiper blade 30 has outlasted its usefulness, it is then simply replaced—rather than the entire wiper and block.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and we do not wish to be restricted to the specific form shown or uses mentioned, except as defined in the accompanying claims.

We claim:

1. An adjustable wiper die for bending tubular members, comprising:

a carriage member defining a fixed die block having a longitudinal channel formed therein;

an adjustable wiper blade adapted to be received in said channel of said carriage member;

an adjustable gauge means for selectively positioning said wiper blade in said carriage; and means for securing said wiper blade in a selected position relative to said carriage.

2. An adjustable wiper die as recited in claim 1, wherein said wiper blade is formed having a longitudinal channel to receive tubular members therein, and wherein the leading edge of said wiper blade defines a protruding lip portion which extends outwardly from said carriage member.

3. An adjustable wiper die as recited in claim 1, wherein said wiper blade is formed having a semi-circular longitudinal channel to receive tubular members therein, and wherein the leading edge of said wiper blade defines a protruding lip portion which extends outwardly from said carriage member.

4. An adjustable wiper die as recited in claim 3, wherein said lip portion is formed having a compound curved surface on the contact side thereof, so as to match the engaging die surface of an associated bending die.

5. An adjustable wiper die as recited in claim 1, wherein said adjustable gauge means comprises:

a screw pin adapted to be rotatably supported in said carriage member;

a longitudinal recess formed in said carriage, through which said screw pin is positioned;

a pawl member threadably mounted to said screw pin for longitudinal placement within said longitudinal recess;

at least one transversely disposed notch formed in said wiper blade and adapted to receive said pawl therein, whereby said wiper blade can be longitudinally positioned in said channel of said carriage member.

6. An adjustable wiper die as recited in claim 3, wherein said wiper blade includes longitudinal grooves disposed along each oppositely disposed longitudinal edge of said wiper blade, and wherein said securing means comprises a pair of rails attached to said carriage member, to engage in said longitudinal grooves of said wiper blade.

7. An adjustable wiper die as recited in claim 4, wherein said channel in said carriage member is formed having a semi-circular configuration, and wherein said wiper blade is formed having a matching semi-circular cross-sectional configuration, said carriage member having a jaw member shaped to be received in said die surface of said associated bending die.

8. An adjustable wiper blade as recited in claim 5, wherein said adjustable gauge means includes means for rotatably securing said screw pin to said carriage member.

* * * * *